US011602227B2

(12) United States Patent
Moon et al.

(10) Patent No.: US 11,602,227 B2
(45) Date of Patent: Mar. 14, 2023

(54) MATTRESSES INCLUDING SPACER FABRIC AND RELATED METHODS

(71) Applicant: Purple Innovation, LLC, Lehi, UT (US)

(72) Inventors: Shawn David Moon, American Fork, UT (US); Lars C. Hamilton, Alpine, UT (US); Tanner R. Wheadon, Lehi, UT (US)

(73) Assignee: Purple Innovation, LLC, Lehi, UT (US)

( * ) Notice: Subject to any disclaimer, the term of this patent is extended or adjusted under 35 U.S.C. 154(b) by 0 days.

(21) Appl. No.: 17/142,147

(22) Filed: Jan. 5, 2021

(65) Prior Publication Data

US 2021/0120970 A1 Apr. 29, 2021

Related U.S. Application Data

(63) Continuation of application No. 15/662,934, filed on Jul. 28, 2017, now Pat. No. 10,881,217.

(51) Int. Cl.
*A47C 27/06* (2006.01)
*A47C 27/045* (2006.01)
*A47C 27/05* (2006.01)

(52) U.S. Cl.
CPC ..... *A47C 27/064* (2013.01); *A47C 27/0453* (2013.01); *A47C 27/053* (2013.01)

(58) Field of Classification Search
CPC ..... A47C 27/064; A47C 27/0453; A47C 27/0456; A47C 27/053; A47C 27/063
See application file for complete search history.

(56) References Cited

U.S. PATENT DOCUMENTS 4,469,739 A * 9/1984 Gretzinger ..... D03D 15/587 297/452.64
5,749,111 A 5/1998 Pearce et al.
6,243,900 B1 6/2001 Gladney et al.
7,640,611 B1 * 1/2010 Kluft ..... A47C 27/064 5/718

(Continued)

FOREIGN PATENT DOCUMENTS

CN 200970040 Y 11/2007
CN 200976985 Y 11/2007

(Continued)

OTHER PUBLICATIONS

Korean Intellectual Property Office, "Notice of Allowance," Korean Application No. 10-2020-7003012, dated May 28, 2021.

(Continued)

*Primary Examiner* — Fredrick C Conley
(74) *Attorney, Agent, or Firm* — Dentons Durham Jones Pinegar

(57) ABSTRACT

A mattress assembly includes a base core layer and an inner core located over the base core layer. The inner core includes coil springs. The mattress assembly also includes a side panel assembly located around a perimeter of the inner core. The side panel assembly includes a spacer fabric located over and transverse to the base core layer. The spacer fabric includes a first knit layer, a second knit layer, and an inner fibrous material located therebetween. Methods of forming the mattress assembly are disclosed.

20 Claims, 3 Drawing Sheets

(56) References Cited

U.S. PATENT DOCUMENTS

| | | | |
|---|---|---|---|
| 7,730,566 | B2 | 6/2010 | Flick et al. |
| 8,434,748 | B1 | 5/2013 | Pearce et al. |
| 8,784,982 | B2 | 7/2014 | Pearce et al. |
| 8,832,888 | B2 | 9/2014 | Chunglo |
| 8,919,750 | B2 | 12/2014 | Pearce et al. |
| 9,066,794 | B2 | 6/2015 | Jusiak et al. |
| 9,345,334 | B2 | 5/2016 | Mossbeck et al. |
| 10,881,217 | B2 | 1/2021 | Moon et al. |
| 2002/0184712 | A1 | 12/2002 | Gladney et al. |
| 2004/0148706 | A1 | 8/2004 | Visser et al. |
| 2006/0030644 | A1 | 2/2006 | Hairston et al. |
| 2006/0030645 | A1 | 2/2006 | Hairston et al. |
| 2007/0261173 | A1 | 11/2007 | Schlussel |
| 2009/0056030 | A1 | 3/2009 | Bolden |
| 2009/0320209 | A1 | 12/2009 | McCain |
| 2010/0115703 | A1 | 5/2010 | Kluft |
| 2011/0314613 | A1 | 12/2011 | Haffner et al. |
| 2013/0025070 | A1 | 1/2013 | Ruehlmann et al. |
| 2013/0043628 | A1 | 2/2013 | Pearce et al. |
| 2014/0373282 | A1 | 12/2014 | Mossbeck et al. |
| 2015/0026897 | A1 | 1/2015 | Chunglo |

FOREIGN PATENT DOCUMENTS

| | | | |
|---|---|---|---|
| CN | 201346046 | Y | 11/2009 |
| CN | 102613836 | A | 8/2012 |
| CN | 102802468 | A | 11/2012 |
| CN | 204292709 | U | 4/2015 |
| CN | 204734212 | U | 11/2015 |
| CN | 106213886 | A | 12/2016 |
| CN | 202604240 | U | 12/2019 |
| EP | 2186447 | A1 | 5/2010 |
| JP | 2003235687 | A | 8/2003 |
| JP | 2004016341 | A | 1/2004 |
| JP | 2008307120 | A | 12/2008 |
| JP | 2010284425 | A | 12/2010 |
| JP | 5216250 | B2 | 6/2013 |

OTHER PUBLICATIONS

Canadian Intellectual Property Office, "Examiner's Report," Canadian Application No. 3,070,066, dated Apr. 8, 2021.
Japan Patent Office, "Notice of Reasons for Rejection," Japanese Application No. 2020-504409, dated Mar. 5, 2021.
Chinese National Intellectual Property AdminisliaLion, "Second Office Action," Chinese Application No. 201810800237.6, dated May 6, 2021.
Canadian Intellectual Property Office, "Commissioner's Notice—Application Found Allowable," Canadian Application No. 3070066, dated Dec. 3, 2021.
IP Australia, "Notice of grant for patent," Australian Application No. 2018307218, dated Oct. 7, 2021.
Japan Patent Office, "Notice of Allowance," Japanese Application No. 2020-504409, dated Oct. 19, 2021.
Taiwan Intellectual Property Office, "Office Action," Taiwan Application No. 108126616, dated Nov. 18, 2021.
Baltex, "Spacer Fabric and 3D Spacer Fabrics", http://www.baltex.co.uk/spacerfabrics (Jun. 30, 2017).
Springs Creative, "What is Spacer Fabric?" http://www.springscreative.com/products/spacerfabric (Jun. 29, 2017).
Apex Mills, Apex Mills Textiles, http://www.apexmills.com/textile/testile-type/3d-spacers/3/?act=textile (Jun. 30, 2017).
IP Australia, "First Examination Report," Australian Application No. 2018307218, dated Jun. 11, 2020.
Chinese National Intellectual Property Administration, "First Office Action," Chinese Application No. 201810800237.6, dated Sep. 1, 2020.
USPTO as International Searching Authority, "International Search Report and Written Opinion," International Application No. PCT/US2018/042331, dated Nov. 26, 2018.
Korean Intellectual Property Office, "Reasons for Rejection," Korean Application No. 10-2020-7003012, dated Nov. 27, 2020.
Taiwan Intellectual Property Office, "First Office Action," Taiwan Application No. 107126144, dated Mar. 18, 2019.
European Patent Office, "Supplementary European Search Report," European Application No. 18838906.8, dated Feb. 12, 2021.

* cited by examiner

MATTRESSES INCLUDING SPACER FABRIC AND RELATED METHODS

CROSS-REFERENCE TO RELATED APPLICATIONS

This application is a continuation of U.S. patent application Ser. No. 15/662,934, filed on Jul. 28, 2017 and titled MATTRESSES INCLUDING SPACER FABRIC AND RELATED METHODS ("the '934 Application"), now U.S. Pat. No. 10,881,217, issued Jan. 5, 2021. The entire disclosure of the '934 Application is hereby incorporated herein.

TECHNICAL FIELD

Embodiments of the disclosure relate generally to cushioning elements such as mattresses including spacer fabrics, and to methods of making such mattresses.

BACKGROUND

Cushioning materials have a variety of uses, such as for mattresses, seating surfaces, shoe inserts, packaging, medical devices, etc. Cushioning materials may be formulated and/or configured to reduce peak pressure on a cushioned body, which may increase comfort for humans or animals, and may protect objects from damage. Cushioning materials may be formed of materials that deflect or deform under load, such as polyethylene or polyurethane foams (e.g., convoluted foam), vinyl, rubber, springs, natural or synthetic fibers, fluid-filled flexible containers, etc. Different cushioning materials may have different responses to a given pressure, and some materials may be well suited to different applications. Cushioning materials may be used in combination with one another to achieve selected properties. For example, mattresses may include pocketed coils in combination with layers of foam, elastomer gels, etc. in order to achieve desired results in the cushioning materials.

In mattresses, springs (e.g., coil springs) may be preferable to foam for their durability and ability to withstand compression. Springs may also impart a feel that may be more desirable to users than that of foam. Despite these advantages, springs may not provide a positive aesthetic and/or tactile experience if they are seen or felt through side panels of the mattress, prompting manufacturers to conceal the feel of springs on the sides of mattresses. One solution includes a wire frame around the edge of the mattress to provide structure to a cover of the mattress. However, the metal of the wire frame may be felt through the cover of the mattress. In addition, such a wire frame may not be particularly suited to handle compression during use and to packing mattresses for shipping and/or storage, such as direct-to-consumer mattresses that are shipped in logs, boxes, etc.

An alternative to conceal the feel and/or visual appearance of springs may be to encase the springs in a foam layer around the perimeter of an inner core of the mattress. While the foam layer may mask the feel of the springs, variations in chemistry and/or manufacturing of the foam may affect quality. In addition, the foam layer may be more susceptible to compression over time due to the foam deteriorating more rapidly than springs. Further, foam encasements may bulge and/or fold during use toward a user's legs, creating both a gap between the materials as well as an undesirable feel along the side panel of the mattress. Alternatively, manufacturers have utilized thicker and/or stiffer side paneling on mattress covers to conceal the feel of springs. However, such side paneling may not entirely cover the springs and may be aesthetically and/or texturally undesirable.

SUMMARY

In some embodiments, a mattress assembly may include a base core layer and an inner core located over the base core layer. The inner core may include coil springs. The mattress assembly may also include a side panel assembly located around at least a portion of a perimeter of the inner core. The side panel assembly may include a spacer fabric located over and extending transverse to the base core layer. The spacer fabric may include a first knit layer, a second knit layer, and an inner fibrous material located therebetween.

In other embodiments, a mattress assembly may include a base core layer and an inner core located over the base core layer, the inner core comprising one or more coil springs. The mattress assembly may also include a side panel assembly located around at least a portion of a lateral perimeter of the inner core. The side panel assembly may include a spacer fabric including a first knit layer, a second knit layer, and an inner fibrous material between the first knit layer and the second knit layer.

In further embodiments, a method of forming a mattress assembly may include providing a base core layer as a substrate for a mattress and disposing a plurality of coil springs positioned within individual casings in an inner core located over the base core layer. The method may include disposing a spacer fabric around a perimeter of the inner core. The spacer fabric may define at least a portion of a side panel assembly of the mattress and the spacer fabric may be positioned over the base core layer. The spacer fabric may include a first knit layer, a second knit layer, and an inner fibrous material located therebetween.

BRIEF DESCRIPTION OF THE DRAWINGS

While the specification concludes with claims particularly pointing out and distinctly claiming what are regarded as embodiments of the present disclosure, various features and advantages of embodiments of the disclosure may be more readily ascertained from the following description of example embodiments of the disclosure when read in conjunction with the accompanying drawings, in which:

DETAILED DESCRIPTION

Figure 1:
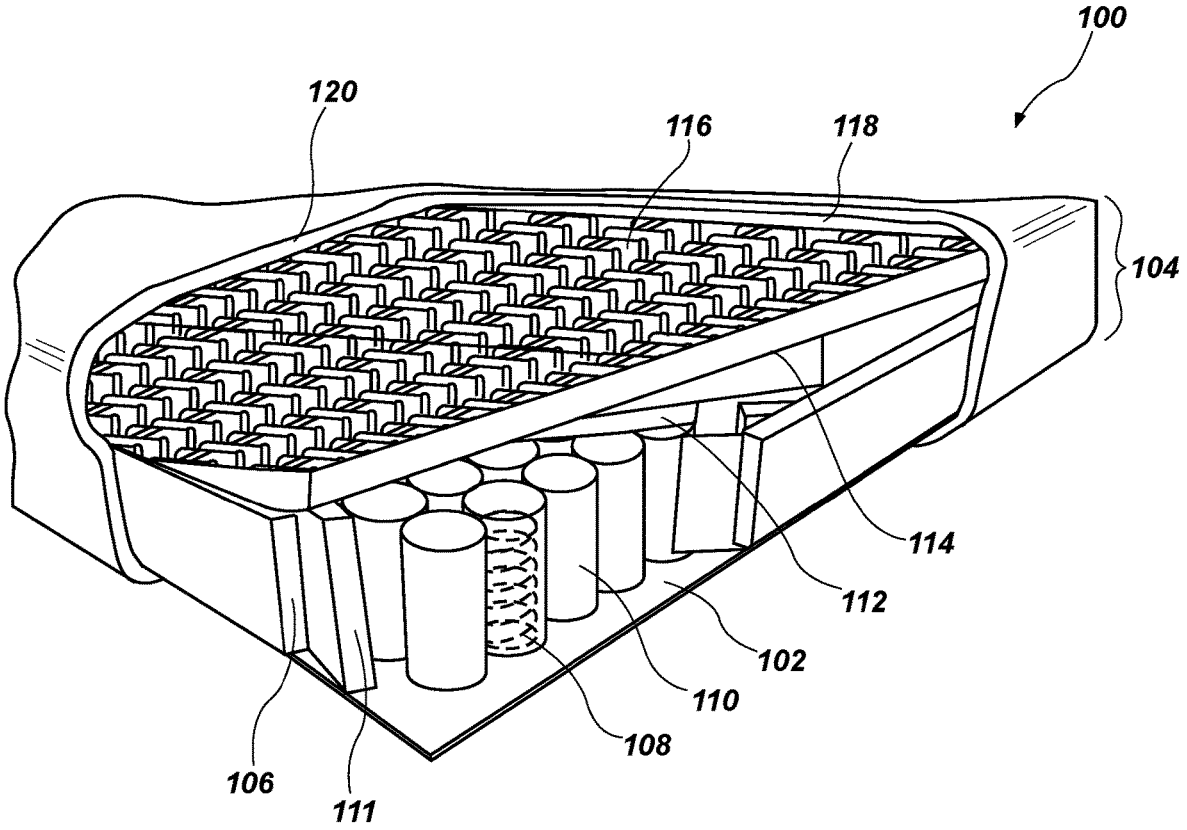
FIG. 1 is a top perspective view of a mattress assembly according to the present disclosure.

The following description provides specific details, such as material types, manufacturing processes, uses, and structures in order to provide a thorough description of embodiments of the disclosure. However, a person of ordinary skill in the art will understand that the embodiments of the disclosure may be practiced without employing these specific details. Indeed, the embodiments of the disclosure may be practiced in conjunction with conventional manufacturing techniques and materials employed in the industry.

In the following detailed description, reference is made to the accompanying drawings, which form a part hereof, and in which is shown, by way of illustration, specific embodiments in which the disclosure may be practiced. These embodiments are described in sufficient detail to enable a person of ordinary skill in the art to practice the disclosure. However, other embodiments may be utilized, and structural, procedural, and other changes may be made without departing from the scope of the disclosure. The illustrations presented herein are not meant to be actual views of any particular system, device, structure, or process, but are idealized representations that are employed to describe the embodiments of the disclosure. The drawings presented herein are not necessarily drawn to scale. Similar structures or components in the various drawings may retain the same or similar numbering for the convenience of the reader; however, the similarity in numbering does not mean that the structures or components are necessarily identical in size, composition, configuration, or other property.

As used herein, the term "and/or" includes any and all combinations of one or more of the associated listed items.

As used herein, the term "substantially" in reference to a given parameter, property, or condition means and includes to a degree that one skilled in the art would understand that the given parameter, property, or condition is met with a small degree of variance, such as within acceptable manufacturing tolerances. For example, a parameter that is substantially met may be at least about 90% met, at least about 95% met, or even at least about 99% met.

As used herein, any relational term, such as "first," "second," "top," "bottom," "upper," "lower," "front," "back," "above," "below," "horizontal," "vertical," "over," "on," etc., is used for clarity, consistency of terminology, and convenience in understanding the disclosure and accompanying drawings and does not connote or depend on any specific preference, orientation, or order, except where the context clearly indicates otherwise. For example, the disclosure includes cushioning elements (e.g., mattresses) that may be rotated or flipped in use such that the top thereof faces down and the bottom thereof faces up, and/or the front faces away from the user and the back faces toward the user. Thus, while one example orientation of mattresses is used herein for clarity, other possible orientations are contemplated by and included in the disclosure.

As used herein, the term "cushioning element" means and includes any deformable device intended for use in cushioning one body (e.g., a person, animal, or object) relative to another. As a non-limiting example, cushioning elements (e.g., mattresses, mattress toppers, seat cushions, etc.) include materials intended for use in cushioning a person, animal, or object relative to another object (e.g., a chair seat) that might otherwise abut against the person, animal or object.

As used herein, the term "elastomeric material" means and includes elastomeric polymers and mixtures of elastomeric polymers with plasticizers and/or other materials. Elastomeric materials are elastic (i.e., capable of recovering size and shape after deformation). Elastomeric materials include, without limitation, materials referred to in the art as "elastomeric cushion members," "elastomer gels," "gelatinous elastomers," or simply "gels."

In some embodiments, a spacer fabric may include material having two separate fabrics, joined by microfilament yarn, to create a breathable, 3D "microclimate" between layers. Spacer fabrics may include uncut pile fabrics including at least two layers of fabric knitted independently that are interconnected by a separate spacer yarn.

In some embodiments, a knitted or knit material may include a fabric formed by interlocking loops of threads or yarns. Such knitted fabrics may be porous and stretchable even when formed of non-stretchable fibers, because the threads can shift within a matrix of loops.

The illustrations presented herein are not actual views of any particular material or device, but are merely idealized representations employed to describe embodiments of the present disclosure. Elements common between figures may retain the same numerical designation.

Embodiments of the present disclosure describes mattresses including a spacer fabric (i.e., 3D fabric having multiple layers of varying materials in a sandwiched configuration) located in and/or defining a side panel assembly thereof. The spacer fabric can be of a sufficient thickness and having suitable compressive properties (e.g., resilience and/or resistance) for providing some cushioning effect when used in conjunction with a mattress, mattress topper, or other cushioning element having side panels. The spacer fabric may alleviate problems associated with cushioning materials (e.g., springs) being felt or seen through the side panels of the mattress. In particular, the spacer fabric located in the side panel assembly may reduce local buckling toward a user's legs during use, and thus a mattress utilizing such spacer fabric may be more comfortable and/or visually attractive to the user. In addition, use of the spacer fabric in the side panel assembly of a mattress as disclosed herein may allow compression in a particular direction (e.g., vertical) in order to facilitate packing of the mattress for shipping and/or storage.

FIG. 1 shows a top perspective view of a mattress assembly 100. For ease of illustration, the mattress assembly 100 of FIG. 1 is shown in a cutaway view in which various portions of the cushioning materials have been removed to reveal internal components thereof. The mattress assembly 100 may include a base core layer 102 having generally planar top and bottom surfaces and a side panel assembly 104 located over (e.g., on, above, directly over) and extending in a plane generally transverse (e.g., perpendicular) to the base core layer 102 (e.g., extending around the lateral or horizontal sides of the mattress assembly 100). The base core layer 102 may be formed of a polyurethane foam, for example, although other foams may be utilized. The side panel assembly 104 may include a spacer fabric 106, which may be located proximate (e.g., at or near) an outer perimeter of the base core layer 102. The base core layer 102 may also support one or more coil springs 108. Individual coil springs 108 (e.g., steel coils) may be encased in respective casings 110 (e.g., polypropylene socks) in which the casings 110 may form a pocket for each of the individual coil springs 108, commonly referred to as "pocketed coils." Individual casings 110 including respective coil springs 108 may be positioned proximate one another and may be located within an inner core 111 of the mattress assembly 100. The coil springs 108 may be aligned vertically (i.e., generally transverse to the base core layer 102) to provide cushioning support. In some embodiments, the casings 110 including the coil springs 108 may be further configured (e.g., encased, joined, etc.) to function as a single body in the inner core 111. An upper foam layer 112 having generally planar top and bottom surfaces may be located over the inner core 111 and thus over upper ends of the casings 110 including the coil springs 108. In some embodiments, a lower surface of the upper foam layer 112 may be located in direct physical contact with an upper surface of the casings 110. In some embodiments, the upper foam layer 112 may be located over and at least partially extended over an upper surface of the spacer fabric 106. The upper foam layer 112 may or may not be attached or adhered (e.g., sewn, glued, etc.) to the spacer fabric 106.

The spacer fabric 106 may include a spacer layer and, in some embodiments, may be utilized to transport moisture vapor and heat away while allowing air flow in addition to providing cushioning support. For example, the spacer fabric 106 may include at least two adjacently stacked layers of three-dimensional material. In some embodiments, the spacer fabric 106 may include a non-crush, three-dimensional (3D) fabric, such as a knit, cloth, polymeric film, foam, and extruded woven fibers. Further, the spacer fabric 106 may include a material having fibers having lateral flexibility for reducing shear forces by providing a degree of lateral flexing during movement. For example, materials of the spacer fabric 106 may be configured to facilitate bending and transverse movement thereof while resisting applied forces in a direction normal to the spacer fabric 106. The spacer fabric 106 may include such 3D materials (e.g., AIRSKIN® spacer fabrics) commercially available through Springs Creative Products Group, LLC of Rock Hill, S.C., to provide cushioning support in at least a portion of the side panel assembly 104.

As shown in FIG. 1, one or more elastomeric cushion members 116 may be located over an upper surface of the upper foam layer 112. The elastomeric cushion member 116 may include a flexible, resilient, gel cushioning media having shape memory. Such gels may be used for cushioning and/or temperature management. Gels may provide cushioning because the gels may hydrostatically flow to the shape of a cushioned object and may tend to relieve pressure peaks and/or gels may reduce stresses from shear. For example, the elastomeric material may increase comfort for a user of the cushioning elements, or may decrease resistance to shear forces which can in turn help prevent decubitus ulcers in medical patients. Such elastomeric cushion members 116 are summarized in U.S. Pat. No. 8,784,982, issued Jul. 22, 2014 to Pearce et al., the disclosure of which is incorporated herein in its entirety by this reference. In addition, the elastomeric cushion members 116 may include interconnected buckling walls summarized in U.S. Pat. No. 8,919,750, issued Dec. 30, 2014 to Pearce et al., which is assigned to the Assignee of the present disclosure, the disclosure of which is incorporated herein in its entirety by this reference.

The elastomeric cushion member 116 may include a stabilizing material 114 on at least a bottom surface thereof. The stabilizing material 114 may include a relatively thin material (e.g., cotton spandex "scrim") and may be used to provide a surface for adhering (e.g., gluing) the elastomeric cushion member 116 to surrounding materials, such as another elastomeric cushion member 116 and/or an upper surface of the upper foam layer 112. In some embodiments, the stabilizing material 114 may comprise a scrim fabric (e.g., a woven or non-woven fabric material) and portions of the elastomeric cushion member 116 may seep through (e.g., be melt-fused into, bleed through, push through, leak through, pass through, etc.) the scrim fabric of the stabilizing material 114. For example, when the elastomeric cushion member 116 includes a gel material, portions of the gel material may be heat fused through the stabilizing material 114. The portions of the elastomeric cushion member 116 that extend through the scrim fabric of the stabilizing material 114 may create a non-slip surface or reduced slip surface on a lower surface of the stabilizing material 114 (e.g., surface that would contact an upper surface of the upper foam layer 112). The non-slip surface or reduced slip surface created by the elastomeric cushion member 116 may help the cushioning materials stay in place relative to one another.

The mattress assembly 100 may also include an optional top layer 118 over an upper surface of the elastomeric cushion member 116. The optional top layer 118 may include, for example, a breathable material (e.g., a material comprising foam or batting fiber). A cover 120 may be located over an upper surface of the optional top layer 118 or, alternatively, over an upper surface of the elastomeric cushion member 116 and/or the upper foam layer 112. In some embodiments, the cover 120 may include a single continuous sheet of material extending over upper surfaces, under bottom surfaces, and around side surfaces of the mattress assembly 100. In other words, the cover 120 may fully encase each of the layers and/or materials within the mattress assembly 100. In other embodiments, the cover 120 may include individual panels or portions that have been joined in order to provide an outer protective covering for at least a portion of the mattress assembly 100.

Figure 2:
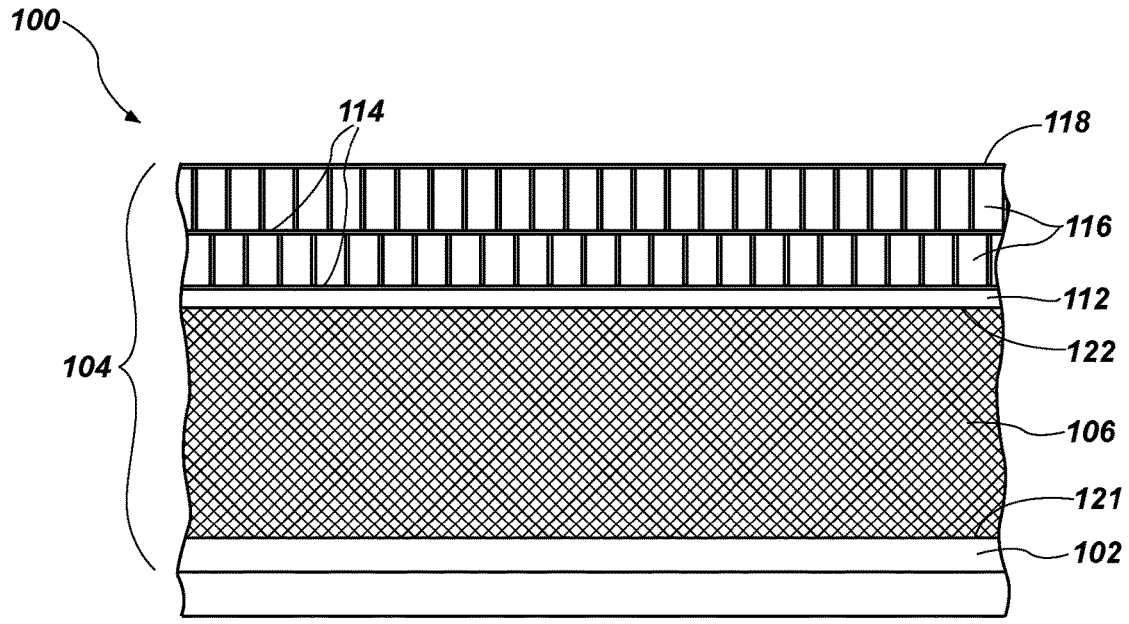
FIG. 2 is an end view illustrating a portion of the mattress assembly shown in FIG. 1 including a spacer fabric coupled with other cushioning elements.

FIG. 2 is an end view illustrating a portion of the mattress assembly 100 including the side panel assembly 104. The end view of FIG. 2 may represent a portion of any one of side surfaces of the mattress assembly 100. A side surface may include a surface disposed along lateral sides (e.g., around a periphery of the mattress) and ends of the mattress assembly 100 that are normally in a substantially vertical orientation during use. The side panel assembly 104 may include the spacer fabric 106 located between the base core layer 102 and the upper foam layer 112 in order to conceal and/or protect components of the inner core 111 (not shown) of the mattress assembly 100. As shown in FIG. 2, the spacer fabric 106 may be located proximate (e.g., at or near) a perimeter of each of the base core layer 102 and the upper foam layer 112 in which each of the base core layer 102 and the upper foam layer 112 may be in direct physical contact with the spacer fabric 106. In some embodiments, the spacer fabric 106 may be positioned between the inner core 111 and the cover 120 (FIG. 1) and may be in direct physical contact with (e.g., encased only by) the cover 120. In other embodiments, an additional layer of material may be located between the spacer material 106 and the cover 120.

In some embodiments, each of the base core layer 102, the spacer fabric 106, the upper foam layer 112, and the elastomeric cushion member 116 may be sized and positioned such that outer vertical edges thereof define an outer wall of the side panel assembly 104. In such a configuration, an outer portion of the spacer fabric 106 may be substantially aligned with an outer end surface of each of the base core layer 102 and the upper foam layer 112, defining, in part, the outer wall of the side panel assembly 104, and thus providing sidewall structure for the mattress assembly 100. For example, a lower surface of the spacer fabric 106 may abut the upper surface of the base core layer 102 and an upper surface of the spacer fabric 106 may abut the lower surface of the upper foam layer 112. In other embodiments, each of the base core layer 102, the upper foam layer 112, and the elastomeric cushion member 116 may be sized and positioned such that outer vertical edges thereof are internal to the outer wall of the side panel assembly 104 by a distance substantially equal to a thickness of the spacer fabric 106. In such a configuration, the spacer fabric 106 may extend from a top to a bottom of the side panel assembly 104 in which the spacer fabric 106 alone defines an outer wall of the side panel assembly 104.

The spacer fabric 106 may be coupled with other cushioning elements of the mattress assembly 100 in which the spacer fabric 106 may be attached or adhered to surrounding materials utilizing adhesives, thermal bonding, or mechanical fasteners. For example, the spacer fabric 106 may be attached to surrounding cushioning materials using hog rings, zippers, stitching and/or sewing, pockets, staples, buttons, heat fusing, etc. In addition, the spacer fabric 106 may be adhered to surrounding cushioning materials using glue (hot glue, water-based glue, etc.), hook-and-loop adhesives, or other such adhesive materials. In some embodiments, a lower surface of the spacer fabric 106 may be attached or adhered to an upper surface 121 of the base core layer 102 and/or an upper surface of the spacer fabric 106 may be adhered to a lower surface 122 of the upper foam layer 112. In other embodiments, the spacer fabric 106 may not be attached or adhered to either of the base core layer 102 or the upper foam layer 112, but may remain free to move relative thereto. For example, the spacer fabric 106 may be free floating and may rely on tension between the cover 120 and the inner core 111 (FIG. 1) to hold the spacer fabric 106 in place. In some embodiments, the spacer fabric 106 may be sewn into the side paneling of the cover 120 so as to form a part thereof. In yet other embodiments, the spacer fabric 106 may be attached to one or more elements of the inner core 111 of the mattress assembly 100 as described in greater detail below. Further, the spacer fabric 106 may be attached at multiple locations using a combination of attachment and/or adherence articles. When the mattress assembly 100 is subjected to a process involving compression, packing, and decompression, the spacer fabric 106 may bulge or decompress in an unsatisfactory manner. For example, if the spacer fabric 106 is only attached on the top and bottom, the spacer fabric 106 may bulge in the middle when unpacked and/or the spacer fabric 106 may bulge in the middle during use. Alternatively, if the spacer fabric 106 is only attached in the middle, the top and bottom may flare out. Therefore, the spacer fabric 106 may be attached or adhered at strategic locations to ensure satisfactory performance and aesthetics, such as in the middle, as well as at the top and bottom thereof. It may be appreciated that other configurations for attachment may be employed.

The spacer fabric 106 may be wrapped along any one or all four vertical sides of the mattress assembly 100 defining an outer lateral periphery of the mattress assembly 100. In some embodiments, the spacer fabric 106 may be wrapped around the four vertical sides of the mattress assembly 100 in a single continuous piece of fabric. In such a configuration, the spacer fabric 106 may be aligned vertically along at least a portion of the side panel assembly 104 without being aligned horizontally among other cushioning elements of the mattress assembly 100. In other embodiments, the spacer fabric 106 may be wrapped under a lower surface of the base core layer 102 and upward along each of the four vertical sides so as to form a "bucket." It may be appreciated that the spacer fabric 106 may be applied to or within the mattress assembly 100 in any configuration to facilitate coverage of selected portions and/or an entirety of the vertical sides thereof. In some embodiments, the spacer fabric 106 may be utilized in the side panel assembly 104 along an entire vertical side (i.e., top to bottom) of the mattress assembly 100 as described in greater detail above. In other embodiments, the spacer fabric 106 may not extend from the top to the bottom of the mattress assembly 100, but may only extend along a portion of the side panel assembly 104. In such an embodiment, the spacer fabric 106 may be located to cover at least a portion of a designated area, such as to cover at least a portion of the inner core 111 containing the coil springs 108 within the casings 110.

As shown in FIG. 2, one or more (e.g., two) elastomeric cushion members 116 may be located over the upper foam layer 112. As described in greater detail above, the stabilizing material 114 may be located on a bottom surface of each of the elastomeric cushion members 116. In this manner, the stabilizing material 114 may be utilized as a stable surface with which to attach or adhere the elastomeric cushion members 116 to one another and/or to an upper surface of the upper foam layer 112. In some embodiments, the elastomeric cushion members 116 may include a single elastomeric cushion member 116 of a selected thickness in which the thickness thereof may be selected for specific cushioning support. For example, the thickness of the elastomeric cushion member 116 may be selected based at least in part by the size of the mattress assembly 100. By way of non-limiting example, the elastomeric cushion members 116 may have a thickness (e.g., vertical height) of about 2 in (0.0508 m), 3 in (0.0762 m), or 4 in (0.1016 m), which thickness may be dependent in part on the size of the mattress assembly 100 along with desired cushioning properties thereof. The optional top layer 118 may be located over an upper surface of an uppermost elastomeric cushion member 116 and the cover 120 (FIG. 1) may be located over the optional top layer 118 and/or surrounding at least a portion of the mattress assembly 100.

In order to accommodate differing size requirements (e.g., king, queen, full, single, etc.) of the mattress assembly 100 and/or for desired cushioning properties thereof, the size, thickness and stiffness of cushioning materials may be adjusted. In some embodiments, the base core layer 102 may include a foam layer (e.g., high resilience flexible polyurethane foam) having a thickness between about 0.5 in and 2 in. By way of non-limiting example, the base core layer 102 may have a thickness of about lin. In some embodiments, the base core layer 102 may have a bulk foam density of about 2.0 lbs/in$^2$ and may have an Indentation Force Deflection (IFD) between about 40 lbs/50 in$_2$ and 70 lbs/50 in$^2$. Indentation Force Deflection (IFD) is defined as a force required to compress 50 in$^2$ of a 20 in by 20 in by 4 in sample by 25%, as measured in accordance with ASTM Standard D3574 (Standard Test Methods for Flexible Cellular Materials—Slab, Bonded, and Molded Urethane Foams, ASTM Intl, West Conshohocken, Pa., 2011). By way of non-limiting example, the IFD of the base core layer 102 may be about 55 lbs/50 in$^2$. In addition, the spacer fabric 106 may have vertical height of between about 6 in and 9 in. By way of non-limiting example, the spacer fabric 106 may have a vertical height of about 7.5 in. In some embodiments, the upper foam layer 112 may include a foam layer (e.g., high resilience flexible polyurethane foam) having a thickness between about 0.25 in and 1 in. By way of non-limiting example, the upper foam layer 112 may have a thickness of about 0.5 in. In some embodiments, the upper foam layer 112 may have a bulk foam density of about 2.0 lbs/in$^2$ and may have an IFD between about 10 lbs/50 in$^2$ and about 40 lbs/50 in$^2$. By way of non-limiting example, the IFD of the upper foam layer 112 may be about 18 lbs/50 in$^2$.

The elastomeric cushion member 116 may include one or more layers of an elastomer gel material (e.g., a flexible, resilient, gel cushioning media having shape memory) having a thickness of about 2 in (0.0508 m), 3 in (0.0762 m), or 4 in (0.1016 m). Further, in order to accommodate size requirements and/or to achieve a particular look or feel of the mattress assembly 100, the size of the spacer fabric 106, including the stiffness of the micro-filaments, the yarn crimp, the weave or knit, as well as the volume fraction in the spacer fabric 106 may be adjusted. As understood by those of ordinary skill in the art, the durometer (hardness) of such fabric may be controlled by thickness and density of the internal fibers, and the density of the outer layers being connected by such internal fibers. By way of non-limiting example, the spacer fabric 106 may have a material density of about 1200 grams per square meter (g/m$^2$).

EXAMPLES

Example 1

A queen mattress having a side panel height of about 10 in may include the base core layer 102 (e.g., conventional foam) having a thickness of about 1 in, a density of about 1.8 lb/ft.$^3$, and an IFD of about 55 lbs/50 in$^2$. The 10 in queen mattress may include the inner core 111 having a height of about 6.5 in, the upper foam layer 112 (e.g., conventional foam) having a thickness of about 0.5 in, a density of about 1.8 lb/ft.$^3$, and an IFD of about 18 lbs/50 in$^2$, and the elastomeric cushion member 116 having a height of about 2 in in either full coverage (i.e., edge to edge) or in two 25 in by 56 in pieces while leaving a perimeter free of the elastomeric cushion member 116. In some embodiments, the perimeter may include a foam layer (e.g., conventional foam) having a thickness of about 1.95 in, a density of about 1.8 lb/ft.$^3$, and an IFD of about 18 lbs/50 in$^2$. The lateral distance of the foam perimeter may be between about 3 in to about 9 in.

Example 2

A queen mattress having a side panel height of about 12 in may include the base core layer 102 having a thickness of about 1 in, a density of about 1.8 lb./ft.$^3$, and an IFD of about 55 lbs/50 in$^2$. The 12 in queen mattress may include the inner core 111 having a height of about 7.5 in the upper foam layer 112 having a thickness of about 0.5 in, a density of about 1.8 lb/ft.$^3$, and an IFD of about 18 lbs/50 in$^2$, and the elastomeric cushion member 116 having a height of about 3 in in full coverage.

Example 3

A queen mattress having a side panel height of about 14 in may include the base core layer 102 having a thickness of about 1 in, a density of about 1.8 lb/ft.$^3$, and an IFD of about 55 lbs/50 in$^2$. The 14 in queen mattress may include the inner core 111 having a height of about 8.5 in, the upper foam layer 112 having a thickness of about 0.5 in, a density of about 1.8 lb/ft.$^3$, and an IFD of about 18 lbs/50 in$^2$, and the elastomeric cushion member 116 having a height of about 4 in in full coverage.

Figure 3:
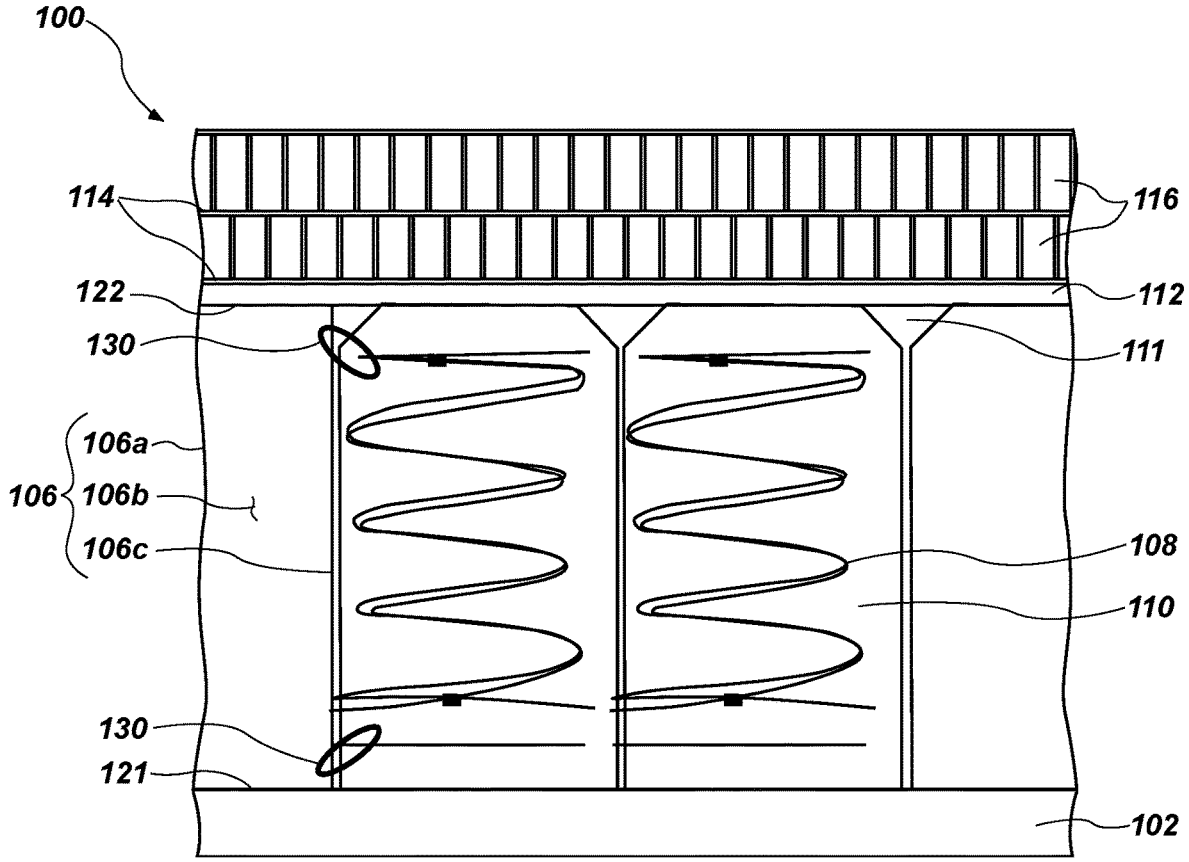
FIG. 3 is a cross-sectional side view illustrating a portion of the mattress assembly shown in FIG. 1.

FIG. 3 is a cross-sectional side view illustrating a portion of the mattress assembly 100 including the spacer fabric 106. The spacer fabric 106 may include a first knit layer 106*a*, an inner fibrous material 106*b*, and a second knit layer 106*c*. The first knit layer 106*a* and the second knit layer 106*c* may be generally aligned (e.g., perpendicular) with one another to support the inner fibrous material 106*b* located (e.g., sewn) therebetween. As shown in FIG. 3, the first knit layer 106*a* may be located proximate the outermost edge of the mattress assembly 100. In other words, the first knit layer 106*a* may define at least a portion of the outer boundary of the side panel assembly 104 and, thus, be located proximate (e.g., at) an outer boundary of the mattress assembly 100, and may further lack cushioning materials (e.g., foam material) in a region between the spacer fabric 106 and the cover 120 (FIG. 1). The second knit layer 106*c* may be located inward from the outer boundary of the mattress assembly 100 and may be located proximate (e.g., at a boundary of) the inner core 111 of the mattress assembly 100. Further, the second knit layer 106*c* may be proximate to (e.g., in direct physical contact with) an outer surface of the outermost casings 110 including the coil springs 108 and may lack cushioning materials (e.g., foam) between the spacer fabric 106 and the inner core 111 including the casings 110 and the coil springs 108.

Portions of the spacer fabric 106 may be attached or adhered to surrounding cushioning materials of the mattress assembly 100. In some embodiments, portions of the spacer fabric 106 (e.g., the second knit layer 106*c*) may be attached or adhered to the outer surface of the casings 110 and/or the coil springs 108. For example, at least a portion of the second knit layer 106*c* and/or at least a portion of the inner fibrous material 106*b* may be coupled to a rung of the outermost coil spring 108. By way of non-limiting example, the spacer fabric 106 may be coupled to the rung of the outermost coil spring 108 using fasteners 130. In some embodiments, fasteners 130 (e.g., hog rings) are only attached or attached primarily to the second knit layer 106*c* of the spacer fabric 106 so as to prevent unnecessary divots and/or indentations along the side panel assembly 104 that would be caused by the fastener 130 pulling an outside edge of the spacer fabric 106 inward. In other embodiments, the fasteners 130 may be attached or adhered (e.g., sewn, glued, heat fused, etc.) to other surrounding materials, such as the base core layer 102, the casings 110, and/or the upper foam layer 112, for example.

Figure 4:
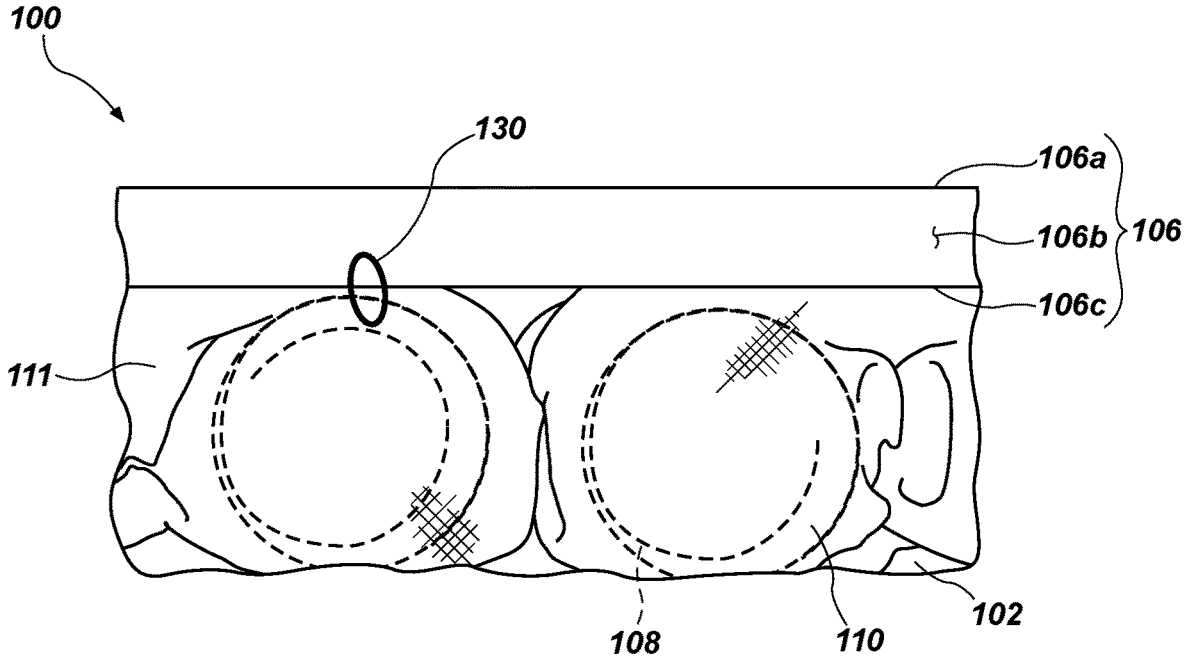
FIG. 4 is a cross-sectional top view illustrating a portion of the mattress assembly shown in FIG. 1.

FIG. 4 is a cross-sectional top view illustrating a portion of the mattress assembly 100. An upper end view of the casings 110 including the coil springs 108 is depicted from looking downward toward the base core layer 102. The casings 110 including the coil springs 108 may be located within the inner core 111 of the mattress assembly 100 as described in greater detail with reference to FIG. 1. The spacer fabric 106 includes the first knit layer 106*a* and the second knit layer 106*c* having the inner fibrous material 106*b* therebetween. In some embodiments, portions of the spacer fabric 106 (e.g., the second knit layer 106*c*) may be attached or adhered to the outer surface of the casings 110 and/or the coil springs 108. For example, the fasteners 130 may extend through at least a portion of the second knit layer 106*c* and/or at least a portion of the inner fibrous material 106*b*, through at least a portion of the casings 110, and coupled to a rung of the outermost coil spring 108. By way of non-limiting example, the spacer fabric 106 may be coupled to the rung of the outermost coil spring 108 using the fasteners 130 (e.g., hog rings). In other embodiments, at least a portion of the spacer fabric 106 may be adhered (e.g., sewn, glued, etc.) to surrounding materials, such as the casings 110, for example.

In some embodiments, the spacer fabric 106 may be formulated such that the spacer fabric 106 is more readily compressible in a direction that is generally transverse (e.g., perpendicular) to threads of the inner fibrous material 106*b*. For example, the spacer fabric 106 may be relatively more compressible along a first axis (e.g., vertical axis) than that of a second axis and a third axis (e.g., horizontal axes), which axes are located generally transverse (e.g., perpendicular) to the first axis. In other words, the spacer fabric 106 may be configured and positioned to exhibit a first elasticity along the first axis (e.g., vertical axis) having a relatively greater elasticity (e.g., modulus of elasticity) than that of a second and third elasticity along each of the second axis and the third axis. In this manner, the mattress assembly 100 including the side panel assembly 104 may allow deformation (e.g., compression) in a designated direction (e.g., vertical direction) in order to facilitate packing of the mattress assembly 100 for shipping and/or storage. Such relative elasticity properties may be determined by an inherent knitted pattern in each of the first knit layer 106*a* and the second knit layer 106*c*. For example, each of the first knit layer 106*a* and the second knit layer 106*c* may include a knitted pattern having an increased elasticity (e.g., a lower relative stiffness, more susceptible to buckling) along the first axis (e.g., vertical axis) while having a reduced elasticity (e.g., a higher relative stiffness, less susceptible to buckling) along the second axis (e.g., lateral). In such an embodiment, the fibers of the inner fibrous material 106*b* are disposed along the third axis (e.g., lateral axis) extending from the outermost edge of the side panel assembly 104 inward toward the inner core 111 thereof. In some embodiments, the compressibility (e.g., decrease of an initial thickness due to an increase of compressive force) of the spacer fabric 106 along the first axis may be greater than the compressibility of the spacer fabric 106 along the second axis, which in turn is greater than the compressibility of the spacer fabric 106 along the third axis (i.e., aligned with the fibers of the inner fibrous material 106*b*) in order to facilitate compression of the mattress assembly 100. Upon delivery and use thereof, the mattress assembly 100 may be decompressed and restored to a full extent (e.g., may recover from an elastic deformation). In such an embodiment, the spacer fabric 106 may be configured to be decompressed and restored to a full extent without deforming or harming the cushioning materials thereof. Thus, foam products may be reduced (e.g., minimized or eliminated) in the side panel assembly 104 to facilitate compressibility during shipping and/or storing while providing a positive aesthetic and/or tactile experience during use.

Additional non-limiting example embodiments of the disclosure are described below.

Embodiment 1: A mattress assembly, comprising: a base core layer; an inner core located over the base core layer, the inner core comprising coil springs; and a side panel assembly located around at least a portion of a perimeter of the inner core, the side panel assembly comprising a spacer fabric located over and extending transverse to the base core layer, wherein the spacer fabric comprises a first knit layer, a second knit layer, and an inner fibrous material located therebetween.

Embodiment 2: The mattress assembly of Embodiment 1, further comprising: at least one elastomeric cushion member located over the inner core; and a stabilizing material located on a lower surface of the at least one elastomeric cushion member.

Embodiment 3: The mattress assembly of Embodiment 2, wherein the stabilizing material comprises a thin material comprising cotton spandex adhered to the lower surface of the at least one elastomeric cushion member.

Embodiment 4: The mattress assembly of Embodiment 2, further comprising: an upper foam layer located between the inner core and the at least one elastomeric cushion member; a cover located over the upper foam layer, the cover disposed around at least a portion of the side panel assembly; and a top layer located between an upper surface of an uppermost elastomeric cushion member and the cover.

Embodiment 5: The mattress assembly of Embodiment 4, wherein a lower surface of the spacer fabric abuts an upper surface of the base core layer and an upper surface of the spacer fabric abuts a lower surface of the upper foam layer.

Embodiment 6: The mattress assembly of Embodiment 5, wherein a region located between the upper surface of the base core layer and the lower surface of the upper foam layer is substantially free of foam material.

Embodiment 7: The mattress assembly of Embodiment 4, wherein an outer surface of each of the base core layer, the spacer fabric, the upper foam layer, and the at least one elastomeric cushion member defines an outer surface of the mattress assembly.

Embodiment 8: The mattress assembly of Embodiment 4, further comprising fasteners coupled between the spacer fabric and at least one of the base core layer, the coil springs, or the upper foam layer, wherein the fasteners comprise at least one of hog rings, zippers, stitching, sewing, pockets, staples, buttons, heat fusing, or adhesives.

Embodiment 9: The mattress assembly of Embodiment 4, wherein the spacer fabric is sewn into a side paneling of the cover.

Embodiment 10: A mattress assembly, comprising: a base core layer; an inner core located over the base core layer, the inner core comprising at least one coil spring; and a side panel assembly located around at least a portion of a lateral perimeter of the inner core, the side panel assembly comprising a spacer fabric including a first knit layer, a second knit layer, and an inner fibrous material between the first knit layer and the second knit layer.

Embodiment 11: The mattress assembly of Embodiment 10, further comprising at least one elastomeric cushion member located over the inner core.

Embodiment 12: The mattress assembly of Embodiment 11, wherein the spacer fabric extends from a location proximate a lower surface of the base core layer to a location proximate an upper surface of an uppermost elastomeric cushion member such that an outer surface of the spacer fabric defines an entire outer lateral surface of the side panel assembly.

Embodiment 13: The mattress assembly of Embodiment 10, wherein: each of the first knit layer and the second knit layer of the spacer fabric comprises at least one of a knit, a cloth, or a polymeric film; and the inner fibrous material comprises extruded woven fibers.

Embodiment 14: The mattress assembly of Embodiment 13, wherein each of the first knit layer and the second knit layer comprises a greater elasticity along a vertical axis of the side panel assembly relative to an elasticity along a lateral axis of the side panel assembly, transverse to the vertical axis.

Embodiment 15: The mattress assembly of Embodiment 11, wherein the at least one elastomeric cushion member comprises interconnected buckling walls.

Embodiment 16: A method of forming a mattress assembly, comprising: providing a base core layer as a substrate for a mattress; disposing a plurality of coil springs positioned within individual casings in an inner core located over the base core layer; and disposing a spacer fabric around at least a portion of a perimeter of the inner core, the spacer fabric defining at least a portion of a side panel assembly of the mattress, the spacer fabric positioned over the base core layer, wherein the spacer fabric comprises a first knit layer, a second knit layer, and an inner fibrous material located therebetween.

Embodiment 17: The method of Embodiment 16, further comprising: disposing at least one elastomeric cushion member over the inner core; and disposing an upper foam layer between the inner core and the at least one elastomeric cushion member.

Embodiment 18: The method of Embodiment 17, further comprising: adhering a thin stabilizing material to a lower surface of the at least one elastomeric cushion member; and adhering a lower surface of the thin stabilizing material to an upper surface of the upper foam layer.

Embodiment 19: The method of Embodiment 17, wherein disposing the spacer fabric around the perimeter of the inner core comprises abutting a lower surface of the spacer fabric against an upper surface of the base core layer and abutting an upper surface of the spacer fabric against a lower surface of the upper foam layer, a thickness of the spacer fabric being substantially equal to a distance that each of the base core layer, the spacer fabric, the upper foam layer, and the at least one elastomeric cushion member extend beyond the inner core.

Embodiment 20: The method of Embodiment 19, wherein disposing the spacer fabric around the perimeter of the inner core further comprises positioning the spacer fabric such that materials thereof exhibit a first compressibility along a vertical axis of the mattress having a relatively greater compressibility than that of a second compressibility along a first horizontal axis of the mattress, transverse to the vertical axis, and a third compressibility along a second horizontal axis of the mattress, transverse to the vertical axis and the first horizontal axis.

While the present disclosure has been described herein with respect to certain illustrated embodiments, those of ordinary skill in the art will recognize and appreciate that it is not so limited. Rather, many additions, deletions, and modifications to the illustrated embodiments may be made without departing from the scope of the disclosure as hereinafter claimed, including legal equivalents thereof. In addition, features from one embodiment may be combined with features of another embodiment while still being encompassed within the scope of the disclosure as contemplated. Further, embodiments of the disclosure have utility with different and various mattress types and configurations.

What is claimed is:

1. A mattress assembly, comprising:

a base;

coil springs over the base; and a side panel around at least a portion of the coil springs and comprising a spacer fabric including at least one knit layer having a greater elasticity along a vertical axis of the side panel than along a lateral axis of the side panel.

2. The mattress assembly of claim 1, wherein the at least one knit layer comprises a first knit layer and a second knit layer superimposed relative to one another.

3. The side panel assembly of claim 2, wherein the spacer fabric further includes a fibrous material between the first knit layer and the second knit layer.

4. The mattress assembly of claim 1, further comprising:

at least one elastomeric cushion over the coil springs.

5. The mattress assembly of claim 4, further comprising:

a stabilizing material between the at least one elastomeric cushion and the coil springs.

6. The mattress assembly of claim 5, wherein the stabilizing material is secured to a lower surface of the at least one elastomeric cushion.

7. The mattress assembly of claim 4, further comprising:

an upper layer between the at least one elastomeric cushion and the coil springs.

8. The mattress assembly of claim 7, wherein a lower edge of the side panel abuts an upper surface of the base and an upper edge of the side panel abuts a lower surface of the upper layer.

9. The mattress assembly of claim 4, further comprising:

a top layer over the at least one elastomeric cushion.

10. The mattress assembly of claim 4, further comprising:

a cover over the at least one elastomeric cushion and around at least a portion of the side panel.

11. The mattress assembly of claim 10, wherein the side panel is secured to an interior of a side panel of the cover.

12. A mattress assembly, comprising:

a base;

coil springs over the base;

an upper layer over the coil springs; and a side panel around at least a portion of the coil springs and comprising a spacer fabric including at least one knit layer having a greater elasticity along a vertical axis of the side panel than along a lateral axis of the side panel.

13. The mattress assembly of claim 12, wherein a lower edge of the side panel abuts an upper surface of the base and an upper edge of the side panel abuts a lower surface of the upper layer.

14. The mattress assembly of claim 12, further comprising:

a cover over the coil springs, the upper layer, and the side panel.

15. The mattress assembly of claim 12, wherein the side panel is secured to interiors of sides of the cover.

16. The mattress assembly of claim 12, further comprising:

at least one elastomeric cushion over the upper layer.

17. A method for assembling a mattress, comprising:

placing coil springs on a base;

positioning a spacer fabric with a lower edge thereof contacting a periphery of the base, the spacer fabric at least partially surrounding the coil springs, the spacer fabric having a greater elasticity along a height of the spacer fabric, perpendicular to the base, than along a lateral extent of the spacer fabric, perpendicular to the height of the spacer fabric; and placing an upper layer over the coil springs.

18. The method of claim 17, wherein positioning the spacer fabric comprises positioning a spacer fabric including a first layer, a second layer, and filler between the first layer and the second layer.

19. The method of claim 18, further comprising:

placing at least one elastomeric cushion over the coil springs.

20. The method of claim 17, wherein placing the upper layer over the coil springs comprises placing the upper layer on an upper edge of the spacer fabric.

* * * * *